US010247206B2

(12) United States Patent
Shimada

(10) Patent No.: US 10,247,206 B2
(45) Date of Patent: Apr. 2, 2019

(54) FLUID CIRCUIT

(71) Applicant: Eagle Industry Co., Ltd., Tokyo (JP)

(72) Inventor: Yoshiyuki Shimada, Tokyo (JP)

(73) Assignee: EAGLE INDUSTRY CO., LTD. (JP)

( * ) Notice: Subject to any disclaimer, the term of this patent is extended or adjusted under 35 U.S.C. 154(b) by 154 days.

(21) Appl. No.: 15/389,046

(22) Filed: Dec. 22, 2016

(65) Prior Publication Data

US 2018/0180065 A1 Jun. 28, 2018

(51) Int. Cl.

| | |
|---|---|
| ***E02F 9/22*** | (2006.01) |
| ***F15B 1/027*** | (2006.01) |
| ***F15B 1/04*** | (2006.01) |
| ***F15B 11/08*** | (2006.01) |
| ***F15B 13/04*** | (2006.01) |
| *E02F 3/32* | (2006.01) |
| *F15B 11/032* | (2006.01) |

(52) U.S. Cl.

CPC ..... *F15B 1/027* (2013.01); *E02F 9/2217* (2013.01); *E02F 9/2228* (2013.01); *E02F 9/2285* (2013.01); *E02F 9/2296* (2013.01); *F15B 1/04* (2013.01); *F15B 11/08* (2013.01); *F15B 13/0401* (2013.01); *F15B 13/0416* (2013.01); *E02F 3/32* (2013.01); *F15B 11/032* (2013.01); *F15B 2201/51* (2013.01); *F15B 2211/30525* (2013.01); *F15B 2211/50563* (2013.01); *F15B 2211/7051* (2013.01); *F15B 2211/88* (2013.01)

(58) Field of Classification Search

CPC ..... E02F 9/2217; F15B 21/14; F15B 1/027

See application file for complete search history.

(56) References Cited

U.S. PATENT DOCUMENTS 5,007,544 A * 4/1991 Saotome ..... B66C 13/18 212/261

5,706,657 A * 1/1998 Amborski ..... E02F 9/2207 60/413

FOREIGN PATENT DOCUMENTS

JP H04120324 A 4/1992 ..... E02F 9/22

* cited by examiner

*Primary Examiner* — Michael Leslie
*Assistant Examiner* — Michael Quandt
(74) *Attorney, Agent, or Firm* — Hayes Soloway P.C.

(57) ABSTRACT

A fluid circuit includes a pressure fluid source, a switching valve, and a cylinder device having first and second chambers and partitioned by a piston. A first accumulator is configured to communicate with the second chamber when pressure fluid is supplied to the first chamber and to accumulate part of the pressure fluid from the second chamber. A pressure booster is connected in hydraulically parallel to the first accumulator, the pressure booster communicative with the second chamber when the pressure fluid is supplied to the first chamber to boost pressure of the pressure fluid by using part of the pressure fluid from the second chamber. A second accumulator accumulates the pressure fluid whose pressure is boosted by the pressure booster.

18 Claims, 10 Drawing Sheets

FLUID CIRCUIT

TECHNICAL FIELD

The present invention relates to a fluid circuit in which a pressure fluid flows into a cylinder to drive a piston, in particular, relates to a fluid circuit in which energy of a pressure fluid is effectively utilized by accumulating a return pressure fluid generated by the piston in an accumulator.

BACKGROUND ART

In order to drive a vehicle, a construction machine, an industrial machine, and the like, a fluid circuit in which a pressure fluid such as hydraulic pressure flows into a cylinder to move a piston and drive a load is conventionally used. In accordance with an operation of returning the piston, the pressure fluid discharged from the cylinder is also stored in an accumulator so as to collect energy of the pressure fluid.

As an example of such a fluid circuit, one example of a hydraulic circuit shown in Patent Citation 1 will be described. With reference to FIG. 10, the hydraulic circuit is mainly formed by a drive mechanism 1, a hydraulic pump 2 for a main circuit, a hydraulic pump 3 for a pilot circuit, a direction switching valve 4, a cylinder device 5, a hydraulic remote controller valve 6, an electromagnetic switching valve 26, an accumulator 27 and a controller 28.

When an operation lever 6-1 of the hydraulic remote controller valve 6 is operated in the contracting direction C and the switching valve 4 is switched to a contracting position 4C, pressure oil from the pump 2 flows into a first oil chamber 5-1 of the cylinder device 5, and oil in a second oil chamber 5-2 passes through an oil passage 23 and is discharged to a tank 11 via the switching valve 4. At this time, an electric signal from a pressure sensor 10 is inputted to the controller 28, the electromagnetic switching valve 26 is switched to an accumulating position 26C, and part of discharge oil of the oil passage 23 passes through an oil passage 30 and is accumulated in the accumulator 27.

When the operation lever 6-1 of the hydraulic remove controller valve 6 is operated in the extending direction E, the switching valve 4 is switched to an extending position 4E, the pressure oil from the hydraulic pump 2 passes through oil passages 12, 15, 23 and flows into the second oil chamber 5-2 of the cylinder device 5, and the oil in the first oil chamber 5-1 is discharged to the tank 11 via the switching valve 4. At this time, an electric signal from a pressure sensor 9 is inputted to the controller 28, the electromagnetic switching valve 26 is switched to a pressure releasing position 26E, and the accumulated oil in the accumulator 27 passes through the oil passages 30, 29, joins the oil passage 23, and is supplied to the second oil chamber 5-2 of the cylinder device 5, that is, regenerated. At the same time, by an electric signal from the controller 28, drive force of the drive mechanism 1 is reduced. Thereby, in comparison to a case where there is no accumulator 27, similar cylinder extension speed can be obtained while reducing power of the drive mechanism 1. As a result, energy saving of the system can be achieved.

CITATION LIST

Patent Citation

Patent Citation 1: Japanese Laid-open Patent Publication 4-120324 (FIG. 2)

SUMMARY OF INVENTION

Technical Problem

With the hydraulic circuit disclosed in Patent Citation 1, energy saving can be achieved. However, when the hydraulic circuit is used for a cylinder device 5 of a boom 5A of a hydraulic excavator as shown in FIG. 1, it is revealed that the following problem occurs. In a state where a bucket is empty with no earth and sand or the like and the bucket is up in the air and when the operation lever 6-1 is operated in the contracting direction C so as to perform an action of lowering the boom 5A, pressure $P_{down}$ accumulated in the accumulator 27 takes a value determined by dividing a load W applied to a rod of a piston 5-3 by a sectional area $S_{HEAD}$ of a head of the piston 5-3 of the cylinder device 5 as shown in the following Expression 1.

$$P_{down}=W/S_{HEAD} \quad \text{(Expression 1)}$$

The load W is by moment generated by self-weight of the boom, an arm, the bucket, each of cylinders, or the like. Pressure losses in the oil passages 23, 29, 30 and the electromagnetic switching valve 26 are ignored.

In a state where the bucket carries earth and sand inside or in a state where external force is applied to the bucket due to an excavating work or the like, that is, when with a load W' (W'>W) applied to the rod of the piston 5-3, the operation lever 6-1 is operated in the extending direction E so as to perform an action of the cylinder device 5 in the extending direction, pressure $P_{up}$ of pressure oil supplied from the pump 2 to the second oil chamber 5-2 of the cylinder device 5 is as shown in the following Expression 2. In this case, the pressure $P_{down}$ accumulated in the accumulator 27 is lower than pressure of the oil passage 23. Thus, there is a problem that regeneration cannot be achieved, and there is some room for improving utilization of the pressure oil.

$$P_{up}=W'/S_{HEAD}(>P_{down}) \quad \text{(Expression 2)}$$

The present invention has been achieved focusing on such a problem, and an objective thereof is to provide a fluid circuit in which energy of a pressure fluid in a cylinder can be effectively reused.

Solution to Problem

In order to achieve the foregoing objective, a fluid circuit according to a first aspect of the present invention includes a pressure fluid source (2) that supplies a pressure fluid, a direction switching valve (4) that switches a supply destination to which the pressure fluid is supplied from the pressure fluid source (2), a cylinder device (5) having first and second chamber (5-2)*s* partitioned by a piston (5-3), the cylinder device (5) in which the pressure fluid is supplied to the first chamber (5-1) or the second chamber (5-2) in accordance with a switching state of the direction switching valve (4), a first accumulator (27) configured to communicate with the second chamber (5-2) when the pressure fluid is supplied to the first chamber (5-1) and to accumulate part of the pressure fluid from the second chamber (5-2), a pressure booster (42) connected in hydraulically parallel to the first accumulator (27), the pressure booster (42) to communicate with the second chamber (5-2) when the pressure fluid is supplied to the first chamber (5-1) and to boost pressure of the pressure fluid by using part of the pressure fluid from the second chamber (5-2), and a second accumulator (43) that accumulates the pressure fluid whose pressure is boosted by the pressure booster (42).

In view of the first aspect, even in a case where the pressure of the pressure fluid supplied from the pressure fluid source to the first chamber is low and the pressure of the pressure fluid supplied from the second chamber to an exterior of the cylinder device is low, the pressure of the pressure fluid can be boosted by using the above pressure fluid and the pressure fluid whose pressure is boosted can be accumulated in the second accumulator in a state where the pressure fluid can be used for the load. Thus, energy of the pressure fluid in the cylinder device can be effectively reused.

The fluid circuit according to a second aspect of the present invention includes a control valve (39) that controls distribution of flow rates of the pressure fluids to be supplied from the second chamber (5-2) to the first accumulator (27) and the pressure booster (42).

In view of the second aspect, by adjusting a control amount of the control valve, the flow rates of the pressure fluids to be supplied from the second chamber (5-2) to the first accumulator (27) and the pressure booster (42) can be divided in the desired proportion.

The fluid circuit according to a third aspect of the present invention is configured such that the first accumulator (27) is to reuse the accumulated pressure fluid for driving the cylinder device, and the first accumulator (27) and the second accumulator (43) are connected to each other via a second switching valve (56).

In view of the third aspect, the first accumulator can accumulate by the pressure fluid of the second accumulator. Thus, an opportunity to utilize the pressure fluid of the first accumulator can be enhanced.

The fluid circuit according to a fourth aspect of the present invention is configured such that in a case where pressure of the second accumulator (43) is higher than pressure of the first accumulator (27), the second accumulator (43) and the first accumulator (27) are connected to each other by the second switching valve (56).

In view of the fourth aspect, the pressure of the second accumulator and the pressure of the first accumulator are compared so as to control the second switching valve. Thus, the second switching valve is not uselessly opened or closed.

The fluid circuit according to a fifth aspect of the present invention, is configured such that in a case where the pressure fluid is supplied from the pressure fluid source (2) to the second chamber (5-2), and when a command value to drive the piston (5-3) is a predetermined value or more, the second accumulator (43) and the first accumulator (27) are connected to each other by the second switching valve (56).

In view of the fifth aspect, when the command value to drive the piston is less than the predetermined value, the piston can be driven by the pressure fluid of the first accumulator, and the second switching valve is placed at a closed position. Thus, the pressure fluid of the second accumulator is not uselessly consumed.

The fluid circuit according to a sixth aspect of the present invention, is configured such that the first accumulator (27) and the second accumulator (43) are respectively connected to the second chamber (5-2) via a first switching valve (26) and a third switching valve (62) so that the individually accumulated pressure fluids are suppliable to the second chamber (5-2).

In view of the sixth aspect, the pressure fluids accumulated in the first and second accumulators can be selectively individually utilized without contact between the pressure fluids. Thus, a control mode for the second chamber can be varied.

The fluid circuit according to a seventh aspect of the present invention is configured such that when pressure of the pressure fluid supplied from the second chamber (5-2) takes a first reference value or lower, the pressure fluid is supplied to the pressure booster (42).

In view of the seventh aspect, even when the pressure of the pressure fluid supplied from the second chamber is low, the high-pressure pressure fluid can be accumulated.

The fluid circuit according to an eighth aspect of the present invention is configured such that when the pressure of the pressure fluid supplied from the second chamber (5-2) takes a second reference value which is larger than the first reference value or more, supply of the pressure fluid to the pressure booster (42) is stopped.

In view of the eighth aspect, when the pressure of the pressure fluid supplied from the second chamber takes the second reference value or more, the pressure of the pressure fluid is not boosted. Thus, pressure boosting which is unnecessary or inefficient for a case where the pressure of the pressure fluid is sufficiently high can be reduced.

The fluid circuit according to a ninth aspect of the present invention further includes a pressure sensor (59) that detects the pressure of the pressure fluid supplied from the second chamber (5-2) is provided.

In view of the ninth aspect, the pressure of the pressure fluid supplied from the second chamber is detected. Thus, whether the pressure is boosted or not can be precisely judged, so that preparations can be made for an action using the pressure fluid of the second accumulator.

The fluid circuit according to a tenth aspect of the present invention is configured such that a proportional control valve (39) is provided between the second chamber (5-2) and the pressure booster (42), and an opening degree of the proportional control valve (39) is controlled in accordance with the command value to move the piston (5-3).

In view of the tenth aspect, by regulating a flow rate by the proportional control valve in a case where the command value to move the piston is small, radical movement of the piston can be suppressed.

DESCRIPTION OF EMBODIMENTS

Modes for implementing the fluid circuit as in the present invention shall be described below based on embodiments.

Embodiment 1

As a fluid circuit according to Embodiment 1, a hydraulic circuit of a hydraulic excavator will be described with reference to FIGS. 1 to 8.

Figure 1:
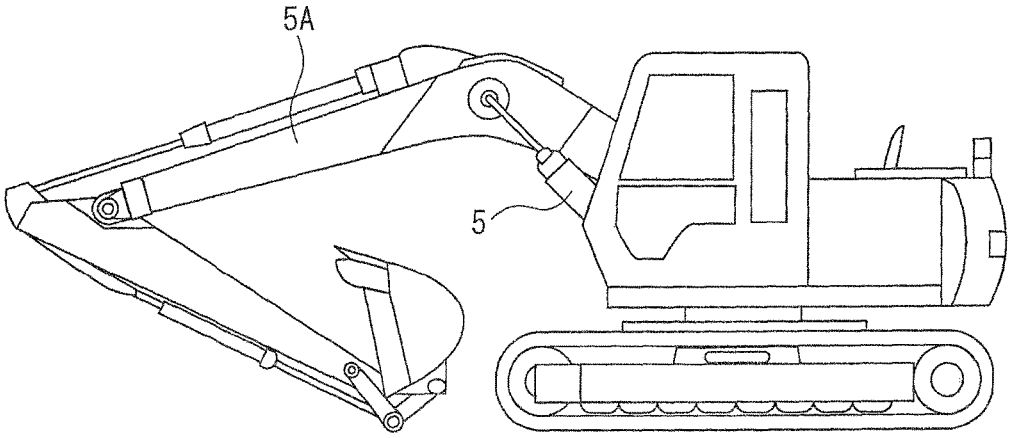
FIG. 1 is a schematic side view of a hydraulic excavator of Embodiment 1.

With reference to FIG. 1, the hydraulic excavator has a bucket to accommodate earth and sand or the like, an arm coupled to the bucket by link connection, a boom 5A coupled to the arm by link connection, and a bucket cylinder device, an arm cylinder device, and a boom cylinder device 5 (simply referred to as the cylinder device 5 as well) to hydraulically drive the bucket, the arm, and the boom. Hereinafter, the hydraulic circuit (fluid circuit) to be used for the boom cylinder device 5 will be described.

Figure 2:
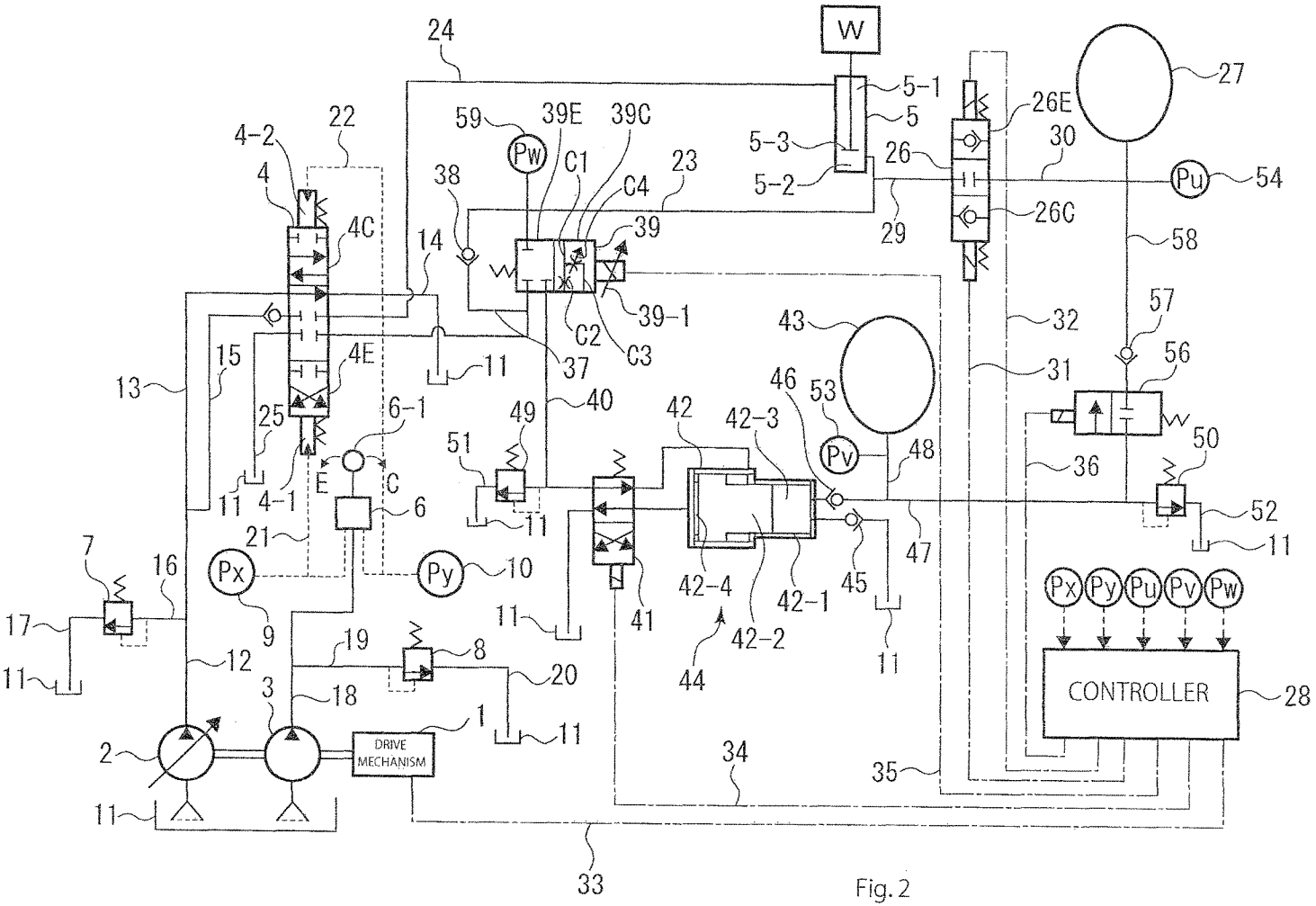
FIG. 2 is a diagram for illustrating a hydraulic circuit of Embodiment 1.

With referent to FIG. 2, the hydraulic circuit mainly includes a variable hydraulic pump 2 for a main circuit to be driven by a drive mechanism 1 such as an engine and an electric motor, a hydraulic pump 3 for a pilot circuit, a direction switching valve 4 (also referred to as the switching valve 4), the cylinder device 5, a hydraulic remote controller valve 6, relief valves 7, 8, 49 and 50, pressure sensors 9, 10, 53, 54 and 59, a tank 11, an electromagnetic switching valve 26 (first switching valve), accumulators 27 and 43 (first and second accumulators), a controller 28, oil passages 12 to 25, 37, 40, 47 to 48, 51, 52 and 58, electric signal lines 31 to 36, check valves 38, 45, 46 and 57, a flow rate adjustment valve 39 (control valve, proportional control valve), electromagnetic switching valves 41 and 56 (second switching valves), and a pressure boosting circuit 44.

The hydraulic pump 2 and the hydraulic pump 3 are coupled to the drive mechanism 1 to be rotated by power from the drive mechanism 1 so as to supply pressure oil to the downstream side. The pressure oil discharged from the hydraulic pump 2 passes through the oil passages 12, 13 and 15, and flows into the switching valve 4. The switching valve 4 is an open-center type six-port three-position switching valve. At a neutral position of the switching valve, all the pressure oil discharged from the hydraulic pump 2 passes through the oil passage 14 and flows to the tank 11.

Figure 3:
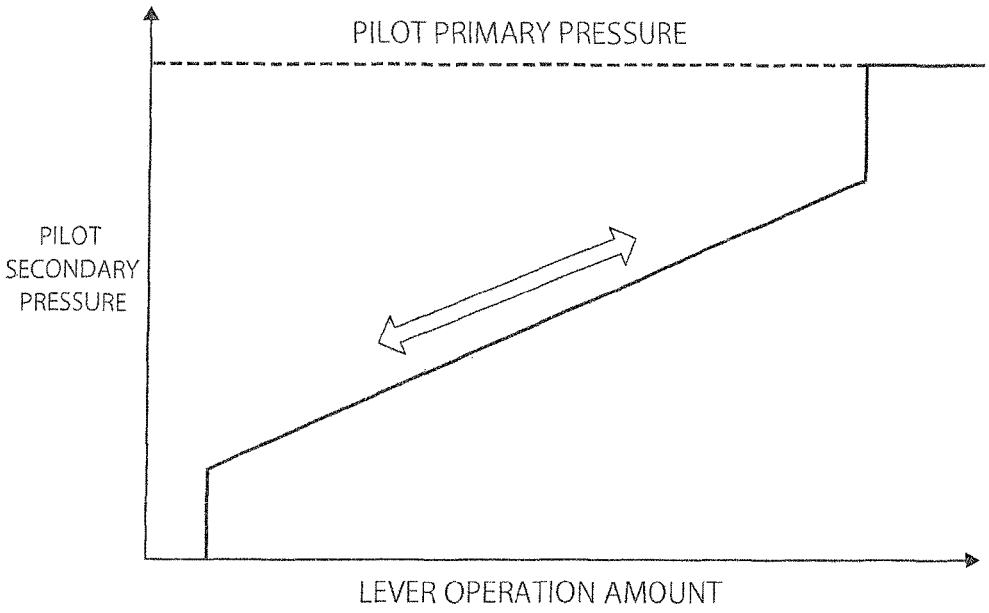
FIG. 3 is a graph for illustrating a relationship between a lever operation amount and pilot secondary pressure in Embodiment 1.

The pressure oil discharged from the hydraulic pump 3 passes through the oil passage 18 and is supplied to the hydraulic remote controller valve 6. The hydraulic remote controller valve 6 is a variable type reduction valve. By operating an operation lever 6-1 forward and backward, reduced secondary pressure passes through the signal oil passage 21 or 22 and is supplied to a signal port 4-1 or 4-2 of the switching valve 4. When the operation lever 6-1 is operated in the extending direction E or the contracting direction C, secondary pressure in proportion to a lever operation amount as shown in FIG. 3 is supplied to the signal port 4-1 or 4-2 of the switching valve 4, and the switching valve 4 is switched to an "extending position 4E" or a "contracting position 4C". It should be noted that all extra oil among the pressure oil discharged from the pump 3, the extra oil not to be supplied to the signal ports 4-1 and 4-2 from the hydraulic remote controller valve 6 passes through the oil passage 19, the relief valve 8, and the oil passage 20 and is discharged to the tank 11. The relief valve 7 is also provided. Thus, when a rod of a piston 5-3 in the cylinder device 5 reaches an extending terminal end or a contracting terminal end or when a radical load is applied to the cylinder and the oil in the circuit is brought into an enclosed state to have abnormally high pressure, the high-pressure oil is discharged to the tank 11 through the oil passages 16 and 17 and the relief valve 7, so that breakage of oil devices in the circuit is prevented. The electromagnetic switching valve 26 is a normal-close type two-port three-position electromagnetic switching valve in which check valves are built at positions 26C and 26E.

Figure 4:
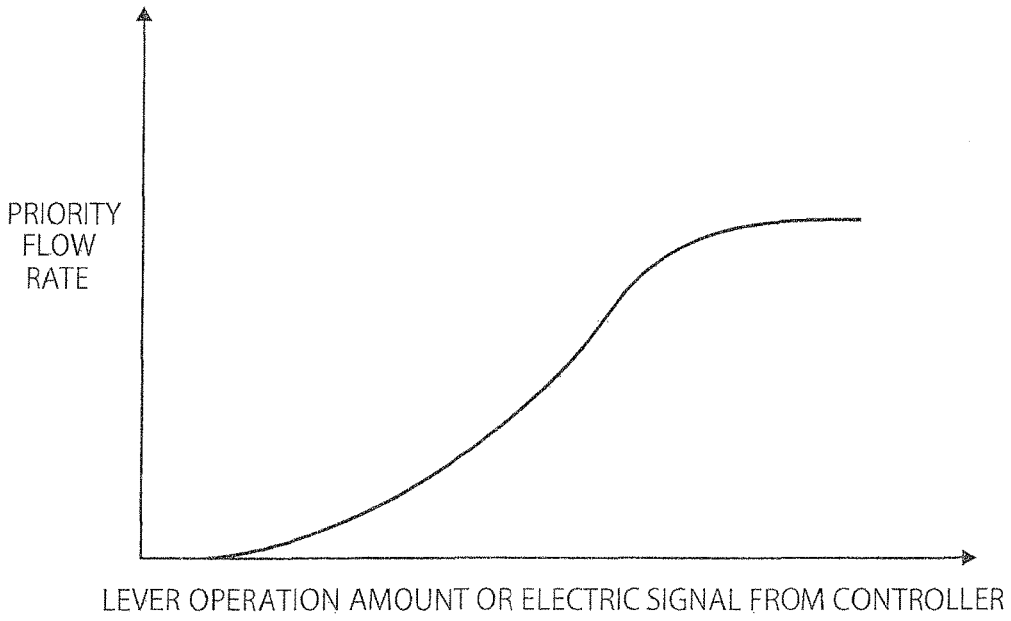
FIG. 4 is a graph for illustrating the lever operation amount or the like and a priority flow rate in Embodiment 1.

In the flow rate adjustment valve 39, a throttle C2 is provided is an oil passage C1, an oil passage C3 branches from the oil passage C1, and a variable throttle C4 is provided in the oil passage C3. The flow rate adjustment valve 39 is a pressure compensated flow rate adjustment valve of an electromagnetic proportional control type capable of variably dividing a priority flow rate by an electric signal from the controller 28, and has a flow rate control characteristic as shown in FIG. 4. When no electric signal is inputted from the controller 28, the priority flow rate is zero, and the priority flow rate can be increased or decreased in proportion to the electric signal from the controller 28. Extra oil flows to the switching valve 4 from the throttle C2.

The pressure boosting circuit 44 includes the electromagnetic switching valve 41, a pressure booster 42 and the accumulator 43. By repeating turning ON/OFF of the electromagnetic witching valve 41 by the electric signal from the controller 28, a piston 42-2 enclosed in a case 42-1 of the pressure booster 42 reciprocates, so that the oil is suctioned from the tank 11 into an oil chamber 42-3 partially defined by a leading end part of the piston 42-2 through an oil passage and the check valve 45. By repeating an action of pushing this oil into the accumulator 43 through the check valve 46 and the oil passages 47 and 48, the pressure oil is accumulated in the accumulator 43. The piston 42-2 includes a large diameter part and a small diameter part. On the so-called Pascal's law, by load pressure in an oil chamber 42-4, the pressure in the oil chamber 42-3 is boosted based on the ratio of sectional areas of the large and small diameters parts. Although the example where the differential pressure type piston 42-2 is used as the pressure booster 42 is described above, other type of pressure booster (such as a pressure booster of a type of boosting pressure fluid itself supplied from a second oil chamber 5-2) may be used.

The relief valves 49 and 50 are provided. Thus, when the pressure becomes abnormally high in the cylinder device 5 or the accumulator 43, the high-pressure oil is discharged to the tank 11 through the oil passages 51 and 52, so that breakage of oil devices in the circuit including the accumulator 43 is prevented. The electromagnetic switching valve 56 is a normal-close type two-port two-position electromagnetic switching valve to be switched by the electric signal from the controller 28, so that the accumulated oil in the accumulator 43 can be supplied to the accumulator 27 via the oil passage 47, the check valve 57 and the oil passage 58.

<Extending Operation>

When the operation lever 6-1 is operated in the extending direction E, the switching valve 4 is switched to the extending position 4E, and the pressure oil from the pump 2 passes through the oil passages 12, 15 and 37, the check valve 38, and the oil passage 23 and flows into a second oil chamber 5-2 of the cylinder device 5. At this time, an electric signal from the pressure sensor 9 is inputted to the controller 28, the electric signal from the controller 28 is inputted to the electromagnetic switching valve 26 through the electric signal line 32, the electromagnetic switching valve 26 is switched to the extending position (pressure releasing position) 26E, and the accumulated oil in the accumulator 27 (a mechanism of accumulating will be described later) passes through oil passages 30 and 29 and joins the oil passage 23, and is supplied to the second oil chamber 5-2 of the cylinder device 5, that is, regenerated. At the same time, the electric signal is inputted from the controller 28 to the drive mechanism 1 through the electric signal line 33, and drive force is reduced. Thereby, similar cylinder extension speed can be obtained while reducing power of the drive mechanism 1. As a result, energy saving of the system can be achieved. It should be noted that the flow rate adjustment valve 39 is not switched in a case where the operation lever 6-1 is operated in the extending direction E.

<Contracting Operation>

Figure 5:
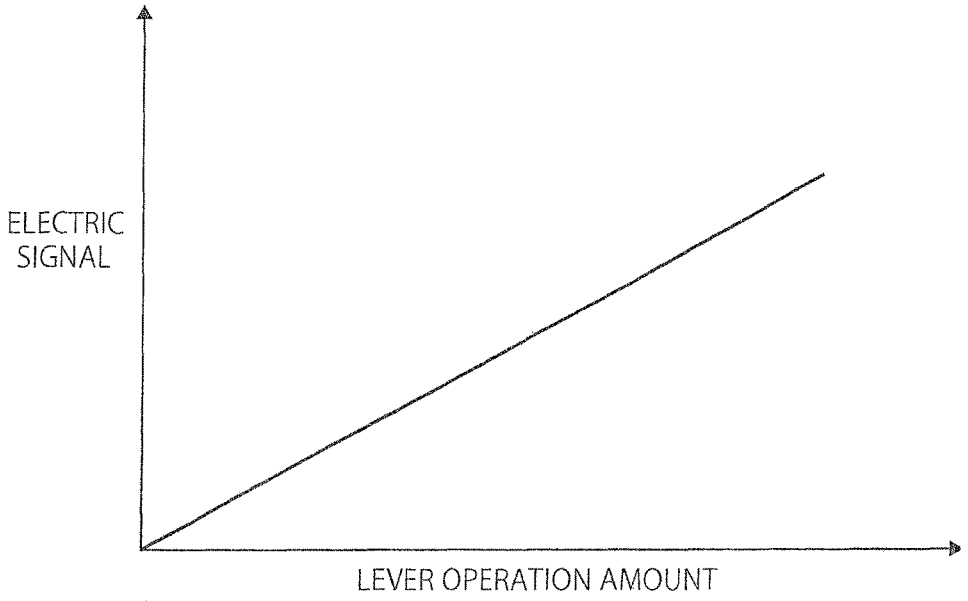
FIG. 5 is a graph for illustrating a relationship between the lever operation amount and an electric signal.

When the operation lever 6-1 of the hydraulic remote controller valve 6 is operated in the contracting direction C and the switching valve 4 is switched to the contracting position 4C, the pressure oil from the pump 2 passes through the oil passages 12, 15 and 24 and flows into a first oil chamber 5-1 of the cylinder device 5. At this time, an electric signal from the pressure sensor 10 installed on the pilot signal oil passage 22 is inputted to the controller 28. Thus, the electric signal is inputted to the electromagnetic switching valve 26 through the electric signal line 31 by an arithmetic circuit mounted in the controller in advance, the electromagnetic switching valve 26 is switched to the contracting position (accumulating position) 26C, and part of discharge oil in the second oil chamber 5-2 passes through the oil passage 30 and is accumulated in the accumulator 27. Similarly, the electric signal in accordance with the operation amount of the operation lever 6-1 as shown in FIG. 5 is inputted to a solenoid 39-1 of the flow rate adjustment valve 39 through the electric signal line 35, the flow rate adjustment valve 39 is switched to a contracting position 39C, the pressure oil in the second oil chamber 5-2 is discharged to the tank 11 through the oil passage 23, the flow rate adjustment valve 39, the switching valve 4 and the oil passage 25, and the pressure oil divided to be an amount in accordance with the operation amount of the operation lever 6-1 by the flow rate adjustment valve 39 is supplied to the pressure booster 42.

By a pressure boosting action using the pressure oil inputted to the pressure boosting circuit 44, the pressure of the oil from the tank 11 is boosted to be pressure Ph which is higher than pressure $P_{down}$ (already described by Expression 1) of the inputted pressure oil, and the pressure oil of the pressure Ph is accumulated in the accumulator 43. For example, in a case of $Ph>P_{down}$, when electric signals from the pressure sensors 53 and 54 are inputted to the controller 28, the electric signal is inputted from the controller 28 to the electromagnetic switching valve 56 through the electric signal line 36 and as a result the electromagnetic switching valve 56 is switched. Thus, the pressure oil in the accumulator 43 passes through the check valve 57 and the oil passage 58 and joins the accumulator 27, and the pressure of the accumulator 27 is boosted to be $P_{down}'$.

For example, the target pressure $P_{down}'$ in the accumulator 27 is made in a relationship of $P_{down}'>P_{up}$ (already described by Expression 2), and in order to realize this, the pressure Ph of the accumulator 43 is used. In this way, in a state where the bucket carries earth and sand inside or in a state where external force is applied to the bucket due to an excavating work or the like, and even in a case where the pressure of the oil supplied from the variable pump 2 to the second oil chamber 5-2 takes $P_{up}$, the accumulated oil in the accumulator 27 can be regenerated in the second oil chamber 5-2 of the cylinder device 5. It should be noted that the target pressure to be accumulated in the accumulators 27 and 43 may be appropriately determined as suitable for use.

Figure 8:
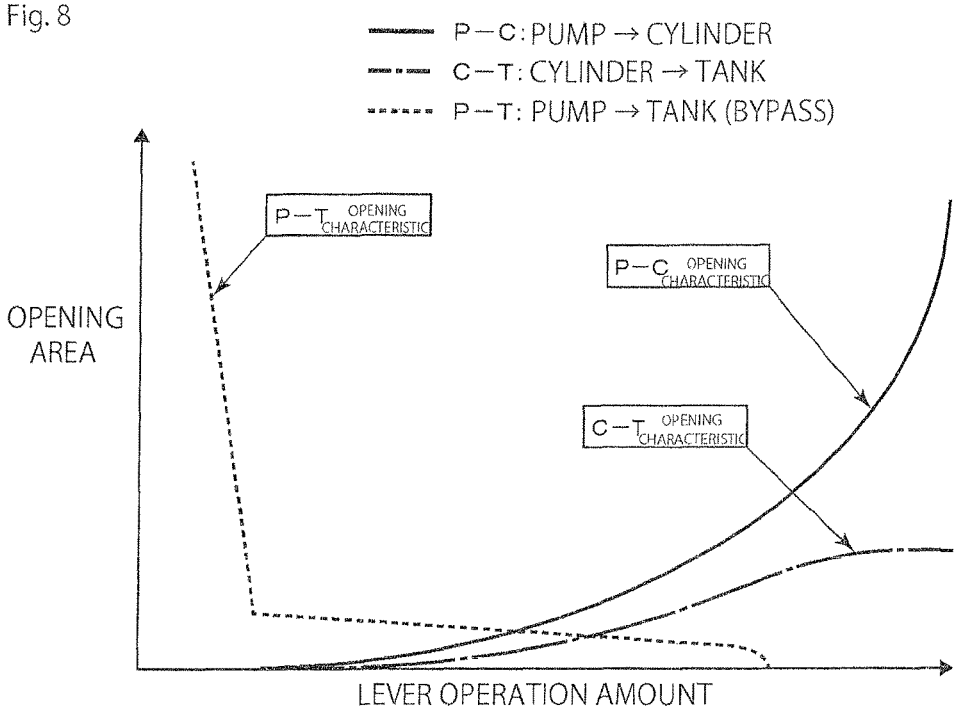
FIG. 8 is a graph showing a relationship between the lever operation amount and an opening area of a direction switching valve in Embodiment 1.

The switching valve 4 has an opening characteristic in accordance with the lever operation amount as shown in FIG. 8. For example, the switching valve controls return oil from the second oil chamber 5-2 of the cylinder device 5 to the tank 11 at the time of a boom lowering operation, so as to control rod speed of the piston 5-3. There is a need for considering a case where the opening characteristic of the switching valve 4 cannot be utilized due to insertion of the flow rate adjustment valve 39 between the switching valve 4 and the cylinder device 5.

In order to deal with this, as described above, the pressure compensated flow rate adjustment valve 39 of an electromagnetic proportional control type having a flow rate control characteristic as shown in FIG. 4 is used so as to take control to gently increase the priority flow rate of the flow rate adjustment valve 39 with respect to a boom lowering lever operation amount as shown in FIG. 4. More specifically, the control is taken so that an increase rate of the priority flow rate is low (inclination is small) in a region where the lever operation amount is small, the increase rate is radically increased (inclination is large) in a region where the lever operation amount is large, and the increase rate is low again (inclination is small) in a region where the lever operation amount is furthermore large. Thu, the rod speed of the piston 5-3 of the cylinder device 5 can be favorably controlled (refer to a solid line of FIG. 7).

Figure 6:
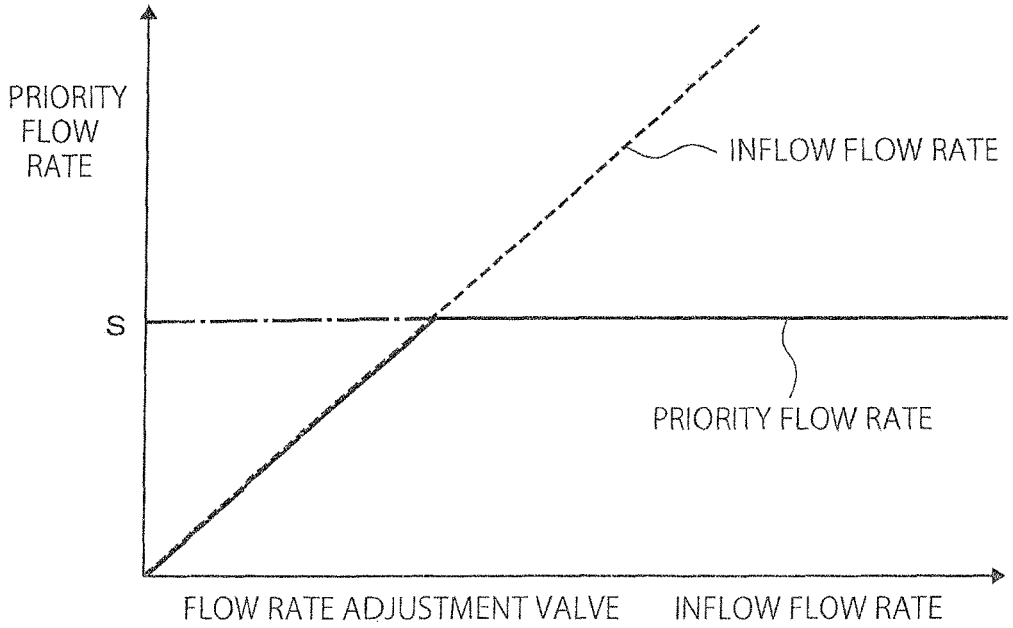
FIG. 6 is a graph for illustrating a relationship between an inflow flow rate of a flow rate adjustment valve and the priority flow rate in Embodiment 1.
Figure 7:
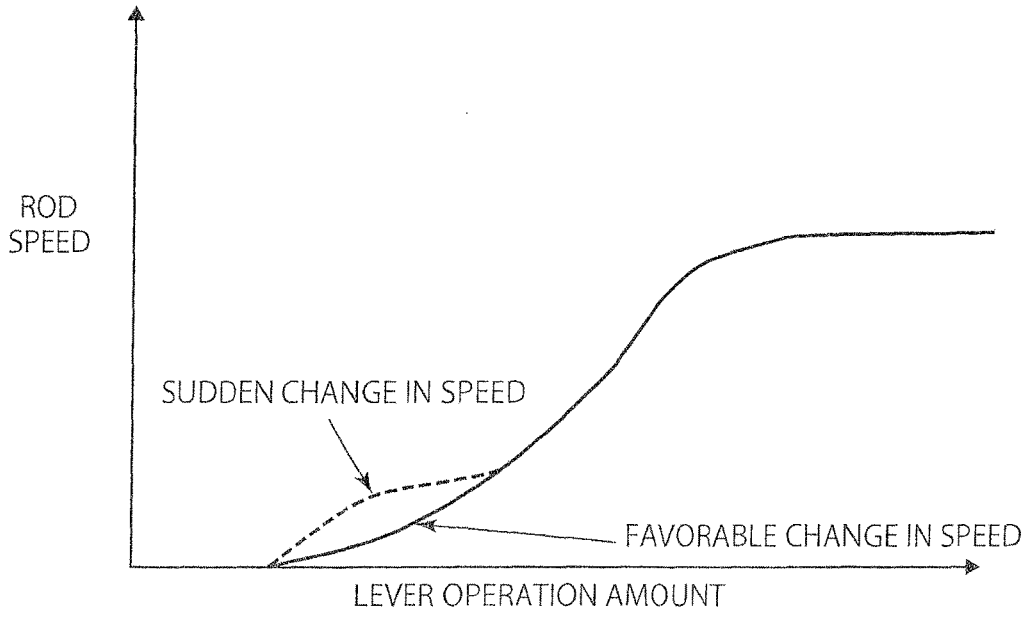
FIG. 7 is a graph for illustrating a relationship between the lever operation amount and rod speed of a piston.

Meanwhile, in a case where a flow rate adjustment valve of a type of dividing a fixed priority flow rate S for which flow rate control cannot be performed with an external signal as shown in FIG. 6 is used, in a region where the flow rate is the priority flow rate S or lower, the return oil going to the flow rate adjustment valve from the second oil chamber 5-2 is not regulated but flows to the pressure boosting circuit on the downstream via the flow rate adjustment valve 39. Thus, retreating speed of the rod cannot be controlled in accordance with the boom lowering lever operation. Therefore, the speed of the cylinder device cannot be favorably controlled by the boom lowering operation lever at the time of the boom lowering operation, and there is a fear that a boom lowering operation property is deteriorated due to a radical change in speed at the beginning of movement of the rod (refer to a broken line of FIG. 7).

The accumulator 27 and the accumulator 43 are connected to each other via the electromagnetic switching valve 56. Therefore, the accumulator 27 can be accumulated by the pressure oil of the accumulator 43. Thus, an opportunity to utilize the pressure oil of the accumulator 27 for regeneration can be increased.

The pressure of the accumulator 43 and the pressure of the accumulator 27 are compared so as to control the electromagnetic switching valve 56. Thus, the electromagnetic switching valve 56 is not uselessly opened or closed.

The pressure sensor 59 that detects the pressure of the pressure oil supplied from the second oil chamber 5-2 is provided. Thus, in comparison to an estimated value in a case where the pressure of the pressure oil supplied from the second oil chamber 5-2 is estimated from a command value of the variable pump 2 or the like, whether the pressure is boosted or not can be precisely judged, so that preparations can be made for an action such as regeneration using the pressure oil of the accumulator 43.

As a modified example of Embodiment 1, distribution of flow rates of the pressure oil to be supplied from the second oil chamber 5-2 to the accumulator 27 and the pressure booster 42 may be controlled by the flow rate adjustment valve 39. In this case, the flow rates of the pressure oil to be supplied from the second oil chamber 5-2 to the pressure booster 42 and the accumulator 27 can be divided in the desired proportion.

In a case where the pressure oil is supplied from the pump 2 to the second oil chamber 5-2, and when a command value to drive the piston 5-3 is a predetermined value or more, the accumulator 43 and the accumulator 27 are connected to each other by the electromagnetic switching valve 56. When the command value to drive the piston 5-3 is the predetermined value or more, the pressure oil of the accumulator 43 can be utilized, and when the command value to drive the piston 5-3 is less than the predetermined value, the piston 5-3 can be driven by the pressure oil of the accumulator 27, and the electromagnetic switching valve 56 is closed. Thus, the pressure oil of the accumulator 43 is not uselessly consumed.

When pressure of the pressure oil supplied from the second oil chamber 5-2 takes a first reference value or lower, the pressure oil may be supplied to the pressure booster 42. In this case, even when the pressure of the pressure oil supplied from the second oil chamber 5-2 is low, the pressure oil whose pressure is higher than the first reference value can be accumulated.

When the pressure of the pressure oil supplied from the second oil chamber 5-2 takes a second reference value which is larger than the first reference value or more, supply of the pressure oil to the pressure booster 42 may be stopped. In this case, when the pressure of the pressure oil supplied from the second oil chamber 5-2 takes the second reference value or more, the pressure of the pressure oil is not boosted. Thus, pressure boosting which is unnecessary or inefficient for a case where the pressure of the pressure oil supplied from the second oil chamber 5-2 and accumulated in the accumulator 27 is sufficiently high can be reduced. Further, the second reference value which is larger than the first reference value is provided, and a zone between the first reference value and the second reference value becomes a dead zone. Thus, even when the pressure of the second oil chamber 5-2 is changed, excessive repetition of turning ON/OFF of the pressure booster 42 can be suppressed.

The two-position switching valve is described as the electromagnetic switching valve 41. However, a three-position switching valve in which a position to directly connect the flow rate adjustment valve 39 to the tank 11 is added may be used. Alternatively, a two-position switching valve having a position to directly connect the flow rate adjustment valve 39 to the tank 11 and a position to connect the upstream and downstream oil passages may be added on the upstream or the downstream of the electromagnetic switching valve 41. By doing so, a case where the pressure oil of the second oil chamber 5-2 is desired to be quickly discharged can be handled.

Embodiment 2

Figure 9:
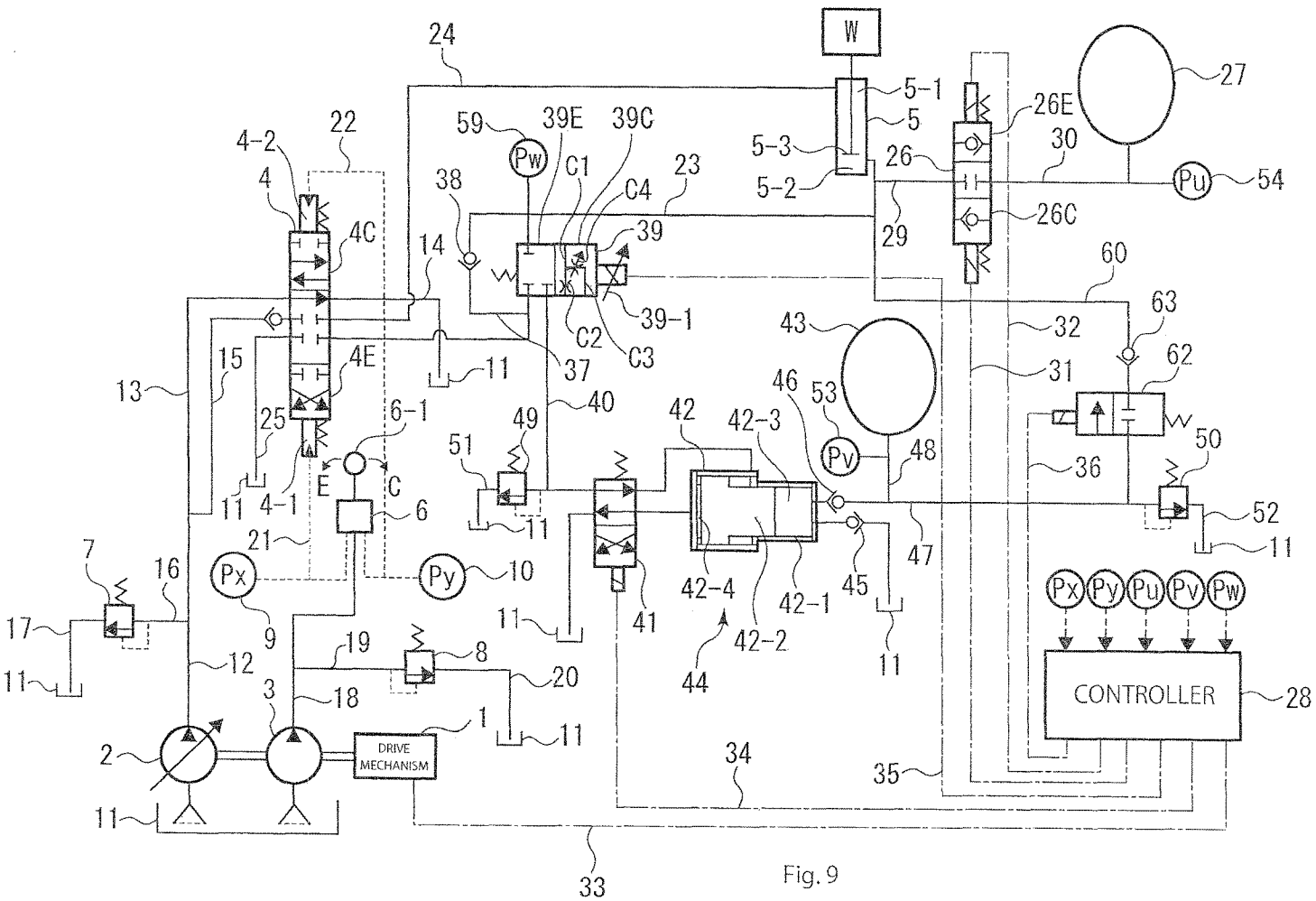
FIG. 9 is a diagram for illustrating a hydraulic circuit of Embodiment 2.
Figure 10:
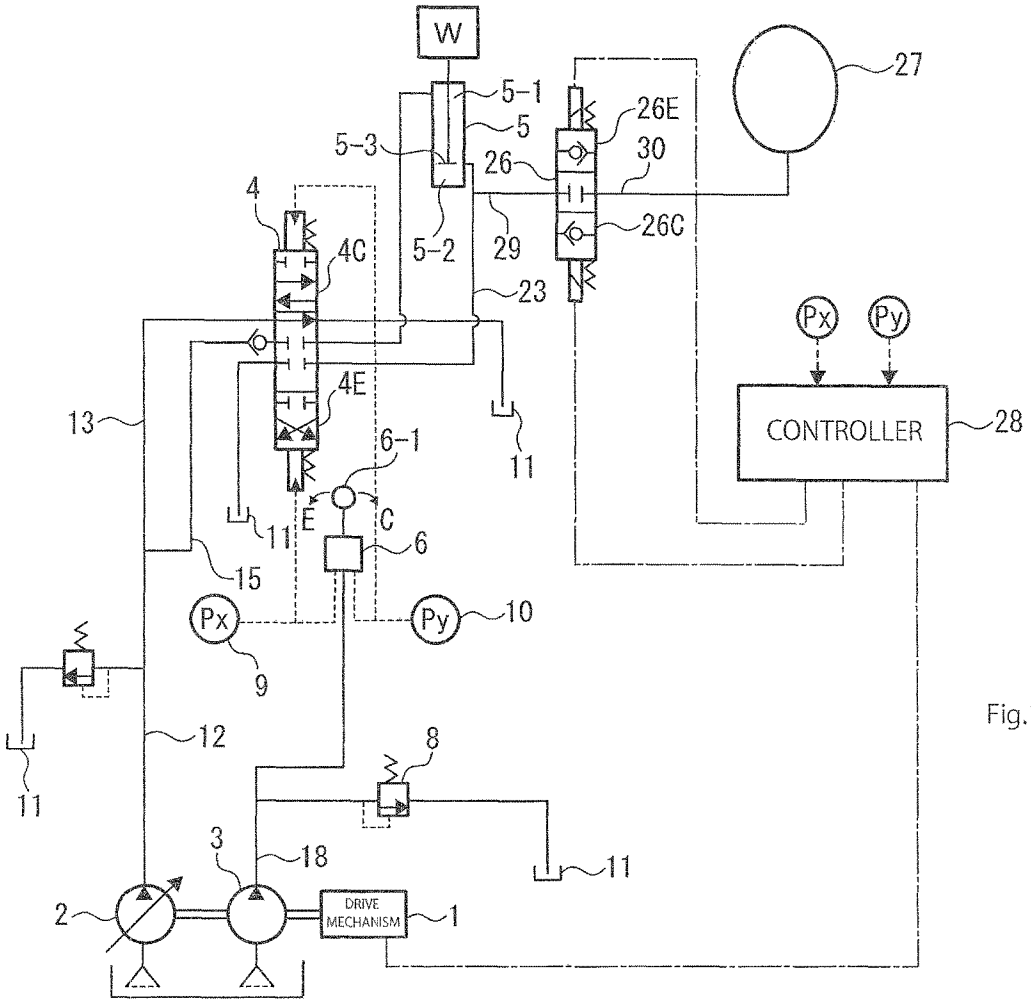
FIG. 10 is a diagram for illustrating a conventional hydraulic circuit.

Next, a fluid pressure circuit according to Embodiment 2 will be described with reference to FIG. 9. It should be noted that the same and overlapping configurations as Embodiment 1 will be omitted. In Embodiment 1, the case where the electromagnetic switching valve 56 is switched in a case of $Ph>P_{down}$, the pressure oil accumulated in the accumulator 43 is supplied, and the pressure of the accumulator 27 is brought to be as high as $P_{down}'$ and then regenerated in the second oil chamber 5-2 of the cylinder device 5 is described. However, as shown in FIG. 9, without the accumulator 43 joining the accumulator 27, an electromagnetic switching valve 62 (third switching valve) may be switched, so that pressure oil of pressure Ph which is higher than pressure $P_{up}$ may be directly supplied to and regenerated in the second oil chamber 5-2 of the cylinder device 5 through a check valve 63 and an oil passage 60. By doing so, the pressure oil accumulated in the accumulators 27 and 43 can be selectively individually utilized without contact between the pressure oil. Thus, a control mode for the second oil chamber 5-2 can be varied.

The embodiments of the present invention are described above with the drawings. However, specific configurations are not limited to these embodiments but any changes and additions within the range not departing from the gist of the present invention are included in the present invention.

In the above embodiments, the hydraulic circuit for the hydraulic excavator is described as the fluid circuit. However, the fluid circuit may be a fluid circuit for any industrial machine other than the hydraulic excavator, a vehicle, or the like. A fluid to be used in the fluid circuit may be any liquid other than oil, or any gas.

The flow rate adjustment valve 39 is switched so that the pressure boosting circuit 44 works only at the time of a contracting action C. Thus, for the hydraulic excavator and the like in which a load W is often small mainly at the time of the contracting action C, the hydraulic circuit is favorably neither enlarged nor complicated. Meanwhile, in a case where efficiency in energy recovery is furthermore improved, a circuit configuration in which the flow rate adjustment valve 39 may be switched so that the pressure boosting circuit 44 works even at the time of an extending action E may be used.

REFERENCE SIGNS LIST

2 Pump
4 Direction switching valve
5 Boom cylinder device (cylinder device)
5-1 First oil chamber (first chamber)
5-2 Second oil chamber (second chamber)
5-3 Piston
6-1 Operation lever
26 Electromagnetic switching valve (first switching valve)
27 Accumulator (first accumulator)
39 Flow rate adjustment valve (control valve, proportional control valve)
43 Accumulator (second accumulator)
44 Pressure boosting circuit
56, 62 Electromagnetic switching valve (second switching valve, third switching valve)

The invention claimed is:

1. A fluid circuit for a cylinder device that drives a load, comprising:

a pressure fluid source that supplies a pressure fluid;

a direction switching valve that switches a supply destination to which the pressure fluid is supplied from the pressure fluid source;

a cylinder device having first and second chambers partitioned by a piston, the cylinder device in which the pressure fluid is supplied to the first chamber or the second chamber in accordance with a switching state of the direction switching valve;

a first accumulator configured to accumulate part of the pressure fluid from the second chamber when the pressure fluid is supplied to the first chamber;

a pressure booster configured to boost pressure of part of the pressure fluid from the second chamber when the pressure fluid is supplied to the first chamber;

a second accumulator that accumulates the pressure fluid whose pressure is boosted by the pressure booster; and a control valve configured to control distribution of flow rates of the pressure fluids to be supplied from the second chamber to the first accumulator and the pressure booster.

2. The fluid circuit as set forth in claim 1, wherein:

the first accumulator is configured to reuse the accumulated pressure fluid for driving the cylinder device; and the first accumulator and the second accumulator are connected to each other via a second switching valve.

3. The fluid circuit as set forth in claim 2, wherein:

in a case where pressure of the second accumulator is higher than pressure of the first accumulator, the second accumulator and the first accumulator are connected to each other by the second switching valve.

4. The fluid circuit as set forth in claim 3, wherein:

in a case where the pressure fluid is supplied from the pressure fluid source to the second chamber, and when a command value to drive the piston is a predetermined value or more, the second accumulator and the first accumulator are connected to each other by the second switching valve.

5. The fluid circuit as set forth in claim 2, wherein:

in a case where the pressure fluid is supplied from the pressure fluid source to the second chamber, and when a command value to drive the piston is a predetermined value or more, the second accumulator and the first accumulator are connected to each other by the second switching valve.

6. The fluid circuit as set forth in claim 1, wherein:

the first accumulator and the second accumulator are respectively connected to the second chamber via a first switching valve and a third switching valve so that the individually accumulated pressure fluids are suppliable to the second chamber.

7. The fluid circuit as set forth in claim 1, wherein:

when pressure of the pressure fluid supplied from the second chamber takes a first reference value or lower, the pressure fluid is supplied to the pressure booster.

8. The fluid circuit as set forth in claim 7, wherein:

when the pressure of the pressure fluid supplied from the second chamber takes a second reference value which is larger than the first reference value or more, supply of the pressure fluid to the pressure booster is stopped.

9. The fluid circuit as set forth in claim 8, further comprising a pressure sensor that detects the pressure of the pressure fluid supplied from the second chamber.

10. The fluid circuit as set forth in claim 7, further comprising a pressure sensor that detects the pressure of the pressure fluid supplied from the second chamber.

11. The fluid circuit as set forth in claim 1, wherein:

a proportional control valve is provided between the second chamber and the pressure booster; and an opening degree of the proportional control valve is controlled in accordance with the command value to move the piston.

12. A fluid circuit for a cylinder device that drives a load, comprising:

a pressure fluid source that supplies a pressure fluid;

a direction switching valve that switches a supply destination to which the pressure fluid is supplied from the pressure fluid source;

a cylinder device having first and second chambers partitioned by a piston, the cylinder device in which the pressure fluid is supplied to the first chamber or the second chamber in accordance with a switching state of the direction switching valve;

a first accumulator configured to accumulate part of the pressure fluid from the second chamber when the pressure fluid is supplied to the first chamber;

a pressure booster configured to boost pressure of part of the pressure fluid from the second chamber when the pressure fluid is supplied to the first chamber; and a second accumulator that accumulates the pressure fluid whose pressure is boosted by the pressure booster;

wherein:

the first accumulator is configured to reuse the accumulated pressure fluid for driving the cylinder device;

the first accumulator and the second accumulator are connected to each other via a second switching valve; and in a case where pressure of the second accumulator is higher than pressure of the first accumulator, the second accumulator and the first accumulator are connected to each other by the second switching valve.

13. The fluid circuit as set forth in claim 12, wherein:

in a case where the pressure fluid is supplied from the pressure fluid source to the second chamber, and when a command value to drive the piston is a predetermined value or more, the second accumulator and the first accumulator are connected to each other by the second switching valve.

14. A fluid circuit for a cylinder device that drives a load, comprising:

a pressure fluid source that supplies a pressure fluid;

a direction switching valve that switches a supply destination to which the pressure fluid is supplied from the pressure fluid source;

a cylinder device having first and second chambers partitioned by a piston, the cylinder device in which the pressure fluid is supplied to the first chamber or the second chamber in accordance with a switching state of the direction switching valve;

a first accumulator configured to accumulate part of the pressure fluid from the second chamber when the pressure fluid is supplied to the first chamber;

a pressure booster configured to boost pressure of part of the pressure fluid from the second chamber when the pressure fluid is supplied to the first chamber; and a second accumulator that accumulates the pressure fluid whose pressure is boosted by the pressure booster;

wherein:

the first accumulator and the second accumulator are respectively connected to the second chamber via a first switching valve and a third switching valve so that the individually accumulated pressure fluids are suppliable to the second chamber.

15. The fluid circuit as set forth in claim 14, wherein:

when pressure of the pressure fluid supplied from the second chamber takes a first reference value or lower, the pressure fluid is supplied to the pressure booster.

16. The fluid circuit as set forth in claim 15, wherein:

when the pressure of the pressure fluid supplied from the second chamber takes a second reference value which is larger than the first reference value or more, supply of the pressure fluid to the pressure booster is stopped.

17. The fluid circuit as set forth in claim 16, further comprising a pressure sensor that detects the pressure of the pressure fluid supplied from the second chamber.

18. The fluid circuit as set forth in claim 15, further comprising a pressure sensor that detects the pressure of the pressure fluid supplied from the second chamber.

* * * * *